United States Patent [19]

Fisher, Jr.

[11] Patent Number: 4,708,666

[45] Date of Patent: Nov. 24, 1987

[54] TRIAXIAL TO COAXIAL CONNECTOR ASSEMBLY

[75] Inventor: Robert L. Fisher, Jr., Hummelstown, Pa.

[73] Assignee: AMP Incorporated, Harrisburg, Pa.

[21] Appl. No.: 907,701

[22] Filed: Sep. 15, 1986

[51] Int. Cl.[4] ..... H01R 17/18

[52] U.S. Cl. ..... 439/580; 439/578; 439/515; 439/96; 439/98

[58] Field of Search ..... 339/177, 182, 183, 14 R, 339/14 P, 125 R, 126 J, 126 R, 64 M, 217 R, 217 S, 220 R, 221 R, 221 M, 89 C, 90 C

[56] References Cited

U.S. PATENT DOCUMENTS

| | | | |
|---|---|---|---|
| 2,762,025 | 9/1956 | Melcher | 174/88 C |
| 3,319,211 | 5/1967 | Smith et al. | 339/177 R |
| 3,701,083 | 10/1982 | Ziegler, Jr. | 339/64 M |
| 3,701,086 | 10/1972 | Somerset | 339/177 R |
| 3,982,060 | 9/1976 | Avery et al. | 339/177 R |
| 4,241,973 | 12/1980 | Mayer et al. . | |
| 4,255,011 | 3/1981 | Davis et al. | 339/177 R |
| 4,270,214 | 5/1981 | Davis et al. . | |
| 4,397,516 | 8/1983 | Koren et al. . | |
| 4,553,806 | 11/1985 | Forney, Jr. et al. | 339/177 R |
| 4,593,964 | 6/1986 | Forney, Jr. et al. . | |

*Primary Examiner*—Gil Weidenfeld

*Assistant Examiner*—David Pirlot

[57] ABSTRACT

A connector assembly for connecting a triaxial cable to a coaxial cable. The assembly includes a first connector member supporting a plurality of triaxial connectors, and a second connector member matable with said first connector member and supporting a plurality of coaxial connectors. The second connector member includes an electrically conductive support member having a plurality of apertures within which the coaxial connectors are supported, and upon mating of the first and second connector members, the outer contact of each triaxial connector will engage the conductive support member of the second connector member to provide a grounding path to dissipate noise carried by the outer conductor of the triaxial cable. The remaining connections for the center contact and intermediate contact of the triaxial connector are made in a standard fashion to the center contact and outer contact of the coaxial connector. With the present invention, a triaxial cable can be used when desired to provide additional electromagnetic shielding and a greater reduction of noise levels, and a coaxial cable can be used when preferred such as to carry a signal into a housing and into circuitry wherein any noise retained on the outer conductor of a triaxial cable can interfere with proper operation of the circuitry electronics.

18 Claims, 5 Drawing Figures

TRIAXIAL TO COAXIAL CONNECTOR ASSEMBLY

BACKGROUND OF THE INVENTION

The present invention relates generally to electrical connectors and, more particularly, to electrical connector assemblies for connecting triaxial cables to coaxial cables.

Triaxial cables are used in applications wherein enhanced electromagnetic shielding is desired to minimize interference of the signal transmitted by the cable. Frequently, triaxial cables are used to carry signals from a remote location to processing circuitry supported within a housing. In such applications, it is desirable to remove the noise carried by the outer conductor of the triaxial cable prior to entrance of the cable into the housing and into the circuitry, as any noise present on the outer conductor can interfere with the proper functioning of the electronics in the circuitry.

In many prior systems, removal of the noise from the outer conductor of a triaxial cable was attempted by providing an electrical contact with the outer conductor prior to entrance of the triaxial cable into the housing. In such attempts, for example, an electrically conductive termination element or grounding clip was extended through the outer jacket of the triaxial cable into electrical contact with the outer conductor of the cable. The grounding clip provided an external grounding path for noise on the outer conductor prior to entrance of the triaxial cable into the housing.

Mere electrical contact with the outer conductor of the triaxial cable has not proved to be fully satisfactory. In such systems, the triaxial cable continues into the housing and into the circuitry, and if noise carried on the outer conductor of the cable is not fully dissipated through the grounding clip, the noise will be carried into the housing and into the circuitry, and can interfere with the proper operation of the circuitry electronics.

SUMMARY OF THE INVENTION

In the present invention, the outer conductor of the triaxial cable is not only electrically terminated prior to entrance of the cable into a housing and into electronic circuitry within the housing, but is also physically terminated. Accordingly, the outer conductor of the triaxial cable never enters into the housing and never reaches the circuitry therein. With the present invention, a triaxial cable can be used where it is needed, to provide maximum shielding of signals transmitted from a remote location to the housing within which processing circuitry is located, and a coaxial cable can be used where it is preferred to transmit signals within the housing to the circuitry.

The present invention provides an electrical connector assembly for connecting a triaxial cable to a coaxial cable. The connector assembly comprises a triaxial connector including center, intermediate and outer contacts which are adapted to be electrically connected to the center, intermediate and outer conductors, respectively, of a triaxial cable, and a coaxial connector matable with the triaxial connector and including center and outer contacts adapted to be electrically connected to the center and outer conductors, respectively, of a coaxial cable, and grounding means for grounding the outer contact of the triaxial connector upon mating of the coaxial and triaxial connectors. The contacts of the coaxial and triaxial connectors are positioned such that upon mating of the coaxial and triaxial connectors, the center contact of the triaxial connector mates with the center contact of the coaxial connector, the intermediate contact of the triaxial connector mates with the outer contact of the coaxial connector, and the outer contact of the triaxial connector engages the grounding means of the coaxial connector to terminate and ground the outer contact of the triaxial connector.

In a presently preferred embodiment of the invention, the connector assembly comprises a first connector member including a first, electrically insulating support member having a plurality of apertures for supporting a plurality of triaxial connectors, and a second connector member including a second, electrically conductive support member having a plurality of apertures for supporting a plurality of coaxial connectors which are matable with the plurality of triaxial connectors. Upon connection of the first and second connector members, the center and intermediate contacts of the triaxial connector mate with the center and outer contacts of an aligned coaxial connector, respectively, and the outer contact of each triaxial connector engages the inner walls of the aligned aperture in the second, electrically conductive support member to provide a grounding path from the outer contacts through the conductive second support member.

In a further aspect of the invention, each of the coaxial connectors is supported within an insulating tube to electrically insulate each of the coaxial connector from the electrically conductive support member within which each is supported. Retention means are provided to releasably retain the triaxial connectors within their respective apertures in the first support member, to releasably retain the coaxial connectors within their respective insulating tubes, and to releasably retain the tubes within their respective apertures in the second support member.

Further advantages and specific details of the invention will be set forth hereinafter in conjunction with the following detailed description of a presently preferred embodiment.

DETAILED DESCRIPTION OF THE PREFERRED EMBODIMENT

Figures 1, 2:
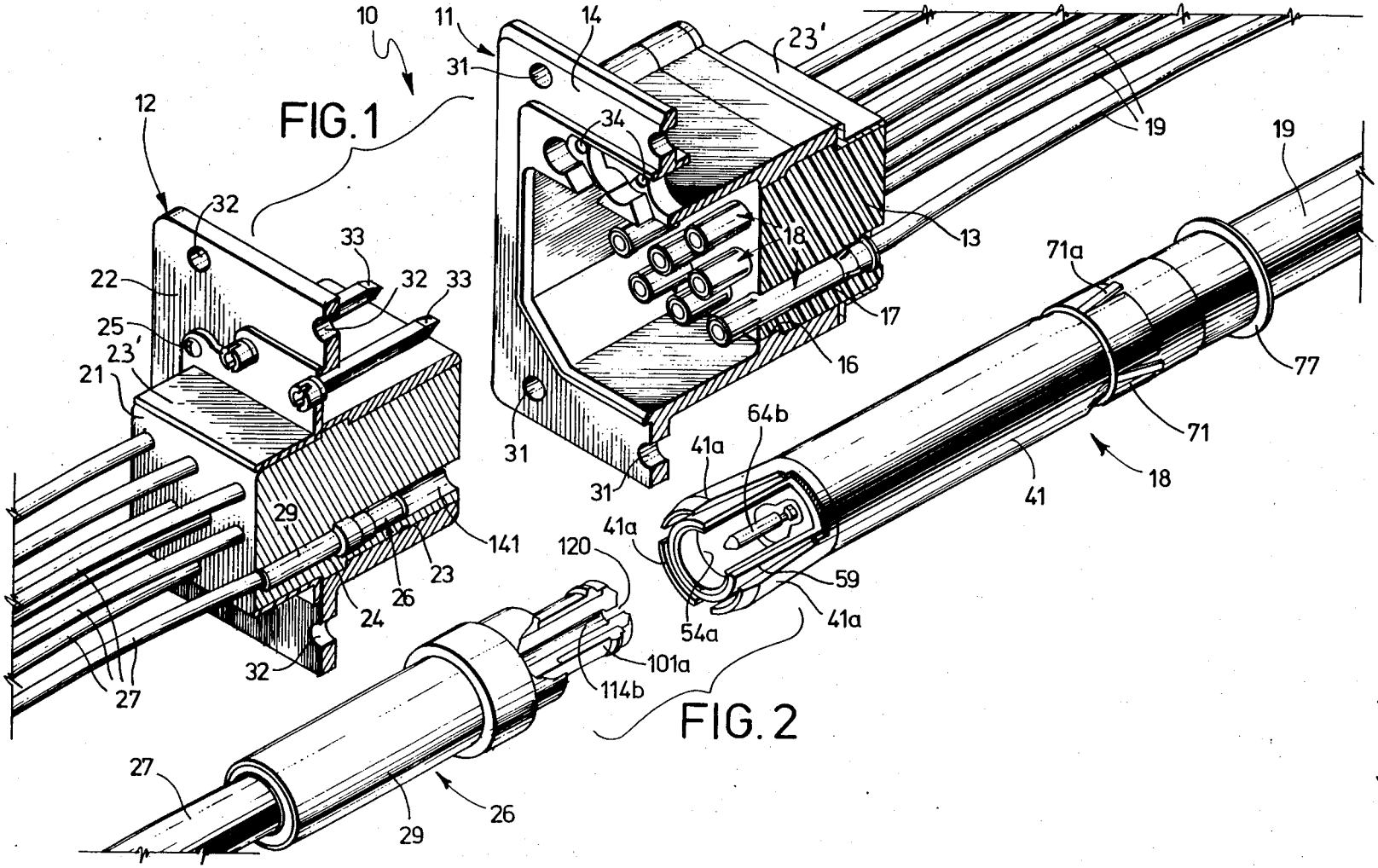
FIG. 1 is a perspective view, partially in section, of a connector assembly according to a presently preferred embodiment of the invention.
FIG. 2 is a perspective view, partially in section, of a coaxial and triaxial connector incorporated within the connector assembly of FIG. 1.

FIG. 1 illustrates a connector assembly according to a presently preferred embodiment of the invention. The assembly is generally designated by reference numeral 10 and comprises a receptacle connector member 11 and a plug connector member 12 which are adapted to be mated to complete electrical circuits through the connector.

Receptacle connector member 11 comprises a connector insert or block 13 supported within an outer shell 14. In particular, shell 14 is configured to define an insert-receiving aperture 16, and insert 13 is adapted to be positioned within aperture 16 and secured therein by a plurality of screws (not shown) extending through aligned apertures in the insert and shell, or in any appropriate manner as is known to those skilled in the art.

Insert 13 comprises a block of generally rectangular cross section having a plurality of apertures 17 extending therethrough. A plurality of socket connectors 18 is positioned within apertures 17, and, as will be described more fully hereinafter, socket connectors 18 comprise triaxial connectors adapted to terminate a plurality of triaxial cables 19. Insert 13 is formed of a plastic epoxy or another suitable electrically insulating material.

Plug connector member 12 comprises a connector insert or block 21 supported within an insert-receiving aperture 23 in an outer shell 22 and secured therein by a plurality of screws 25 extending through aligned apertures in the shell and a back shell 23' encircling the insert. Insert 21 comprises a block of generally rectangular cross section and has a plurality of apertures 24 extending therethrough. A plurality of pin connectors 26 is positioned within apertures 24; and as will be described more fully hereinafter, pin connectors 26 comprise coaxial connectors adapted to terminate a plurality of coaxial cables 27. As will also be explained more fully hereinafter, insert 21 is formed of an electrically conductive material such as an electrically conductive metal, and in order to electrically insulate the individual pin connectors 26 from conductive insert 21, each pin connector 26 is supported in its respective aperture 24 within an insulating tube 29 of polytetrafluoroethylene or another suitable dielectric material.

To connect connector assembly 10, plug connector member 12 is inserted into receptacle connector member 11 and the two connector members are secured together by extending fastening screws (not shown) through aligned apertures 31 and 32 in the outer shells 14 and 22, respectively, of the connector members. Upon being connected, each socket connector 18 will mate with an aligned pin connector 26 to complete electrical circuits through the assembly. Keying means, such as pins 33 on connector member 12 adapted to be received in apertures 34 in connector member 11, are preferably provided to assist in aligning the members for mating.

Triaxial cables 19 are used in applications wherein enhanced electromagnetic shielding is desired to minimize interference of the signal transmitted by the cable. In a typical application, cables 19 can be used to transmit signals from remote locations to centrally located signal processing circuitry. Such circuitry is commonly retained within a housing or other enclosure, and connector assembly 10 can be mounted to a wall of the housing so that triaxial cables 19 carry the signals from remote locations to the housing, and into connector assembly 10, and coaxial cables 27 carry the signals from connector assembly 10 into the housing and to the processing circuitry.

In the embodiment of FIG. 1, a connector assembly 10 is illustrated in which connector members 11 and 12 each contain a single connector insert 13 and 21, respectively. It should be understood that this is exemplary only. Shells 14 and 22 can be configured to have a plurality of insert-receiving apertures for receiving and supporting a plurality of inserts. It should also be understood that the inserts can be designed to support any desired number of connectors arranged in any appropriate configuration for a particular application.

Figure 3:
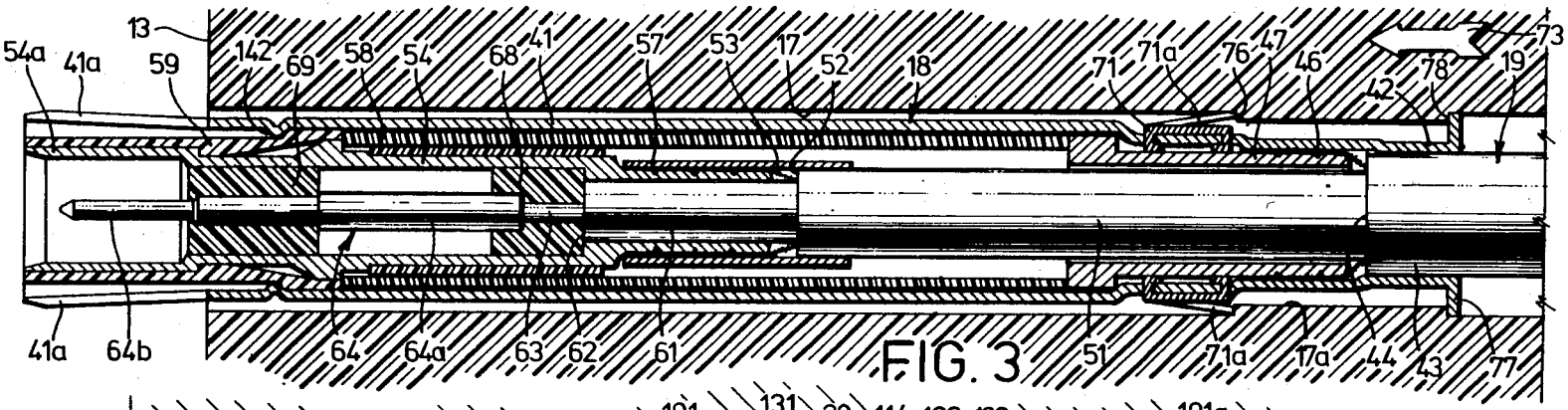
FIG. 3 is a cross-sectional view of a triaxial connector of FIG. 1 supported within its respective aperture.

FIG. 3 is a sectional view of a triaxial connector 18 mounted within an aperture 17 in insert 13. Connector 18 is also illustrated in perspective view in FIG. 2. Triaxial connector 18 comprises a generally tubular-shaped outer shell 41 which is attached to the end of a triaxial cable 19 by being crimped thereto as shown at 42. The outer jacket 43 of the triaxial cable is stripped away at 44 to expose the outer conductor 46 of cable 19. Outer conductor 46 typically comprises a tubular, braided conductor as is known to those skilled in the art. The exposed outer conductor 46 is crimped between the outer shell 41 and an electrically conductive ferrule 47 to electrically couple the outer conductor 46 to the rear end of outer shell 41. A plurality of integral contact fingers **41*a* extends from the forward end of shell 41 as shown in FIG. 2. The bases of the contact fingers 41a are provided with an annular, inwardly extending bend 142 from which the contact fingers 41*a* extend radially outwardly as shown in FIG. 3**.

The intermediate insulation 51 of triaxial cable 19 is stripped away at 52 to expose the intermediate tubular, braided conductor 53. Intermediate conductor 53 is electrically coupled to an inner, electrically conductive shell 54 by being crimped between the inner shell and ferrule 57. The outer shell 41 and the inner shell 54 are electrically insulated from one another by tubular-shaped dielectric members 58 and 59 positioned therebetween. Inner shell 54 includes an integral, annular intermediate contact portion **54*a* at its forward end as shown in FIG. 2**.

The inner insulation layer 61 of triaxial cable 19 is stripped away at 62 to expose center conductor 63. Center conductor 63 is received within center contact 64 which comprises a center conductor-receiving portion **64*a* and a pin contact portion 64*b*. Dielectric members 68 and 69 support center contact 64 axially within the connector assembly and electrically insulate the center contact 64 from the inner shell 54**.

As indicated previously, triaxial connector 18 is mounted within an aperture 17 in insert 13 of receptacle connector member 11. Retention means is provided for releasably securing the connector 18 within insert 13. As shown in FIGS. 2 and 3, the retention means includes an annular retention ring 71 mounted to outer shell 41. Retention ring 71 includes a plurality of integral spring fingers **71*a* extending rearwardly and outwardly therefrom which are adapted to cooperate with an inwardly extending, internal annular shoulder 76 in aperture 17**.

To assemble receptacle connector member 11, each triaxial socket connector 18 is mounted to the end of a triaxial cable 19, and is inserted into an aperture 17 in insert 13 in the direction indicated by arrow 73 in FIG. 3. During insertion, the spring fingers **71*a* will be pressed inwardly by wall portion 17*a* of aperture 17. When spring fingers 71*a* clear shoulder 76, however, the spring fingers 71*a* will spring outwardly as shown in FIG. 3 to thereafter prevent withdrawal of the connector 18 from the insert 13 in the direction opposite that of arrow 73. Insertion of connector 18 into insert 13 in the direction of arrow 73 is also limited by annular flange 77 on the outer shell 41 which impinges against a second internal annular shoulder 78 in aperture 17. Thus, when connector 18 is inserted into aperture 17 in insert 13, the connector will be locked in position by spring fingers 71*a* and flange 77 on the connector cooperating with shoulders 76 and 78, respectively, in the aperture 17. The connector 18 can be removed from the aperture, however, by inserting an appropriate tool into aperture 17 to compress spring fingers 71***a* to permit fingers 71*a* to clear shoulder 76 to allow withdrawal of the connector 18 from aperture 17 in the direction opposite that of arrow 73.

Figure 4:
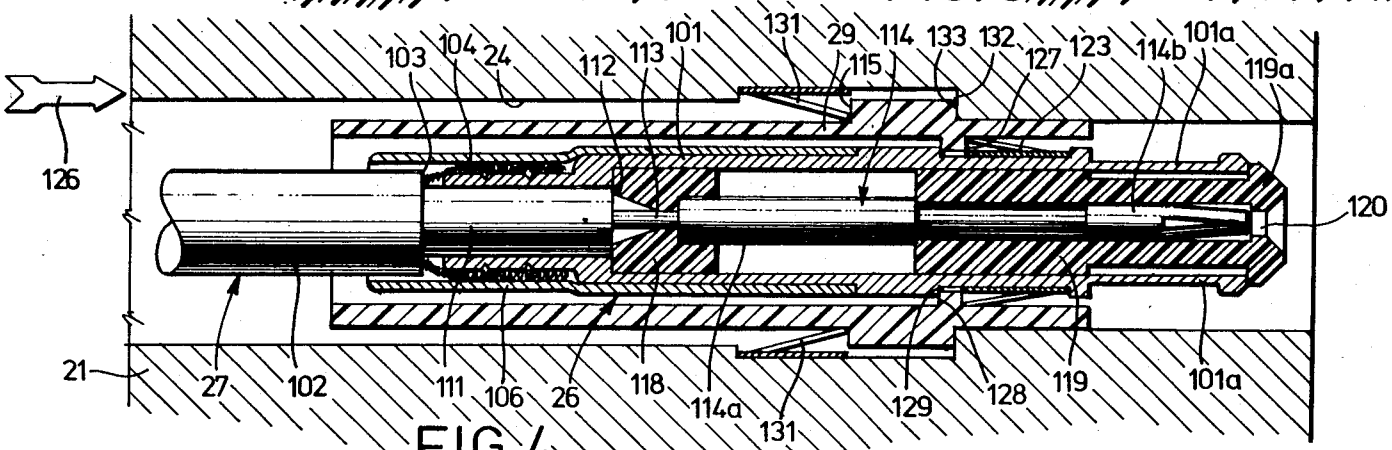
FIG. 4 is a cross-sectional view of a coaxial connector of FIG. 1 supported within an insulating tube.

FIG. 4 is a cross-sectional view of a coaxial pin connector 26 mounted within an aperture 24 in insert 21 of plug connector member 12. Connector 26 is illustrated in perspective view in FIG. 2. Connector 26 comprises a tubular outer shell 101 which is electrically connected to the outer braided conductor 104 of coaxial cable 27. More particularly, outer jacket 102 of coaxial cable 27 is stripped away at 103 to expose outer conductor 104, and outer conductor 104 is electrically connected to the rear end of outer shell 101 by being crimped between the outer surface of the shell and a ferrule 106. Outer shell 101 includes a plurality of integral contact fingers 101a at its forward end.

The inner insulation layer 111 of coaxial cable 27 is stripped away at 112 to expose the center conductor 113 thereof. Center conductor 113 is received within a center contact 114 which comprises a conductor-receiving portion 114a and a socket contact portion 114*b*. Center contact 114 is supported axially within connector 26 and is electrically insulated from the outer shell 101 by dielectric members 118 and 119. Dielectric member 119, in particular, includes a portion 119*a* which extends forwardly beyond the ends of contact portions 101*a* of outer shell 101 and defines a central opening 120 for receiving pin contact portion 64*b* of an aligned socket connector 18 when the connector members are mated.

As indicated previously, coaxial connector 26 is mounted within an insulating tube 29 of polytetrafluoroethylene or other suitable dielectric material. Tube 29 electrically insulates connector 26 from the metallic insert 21 within which it is supported. Connector 26 is provided with retention means 123 to releasably retain it within tube 29. Retention means 123 comprises an annular split retention ring mounted to outer shell 101 of connector 26. Retention ring 123 is adapted to cooperate with an internal annular shoulder 127 in tube 29.

Retention means 131 is also provided to releasably retain plastic tube 29 within aperture 24 of insert 21. Retention means 131 comprises an annular split retention ring mounted within aperture 24. Retention ring 131 is adapted to cooperate with an annular shoulder 115 on tube 29.

To assemble connector assembly 12, connector 26 is first attached to the end of a coaxial cable 27 and is then inserted into tube 29 in the direction indicated by arrow 126. During insertion, the inner wall of tube 29 will compress retention ring 123 to permit insertion of connector 26. When, however, the retention ring clears internal shoulder 127 in the tube, the ring will spring outwardly and thereafter prevent the withdrawal of the connector from the tube in the direction opposite that of arrow 126. Forward movement of the connector within the plastic tube 29 is also restricted by internal shoulder 128 on tube 29 being engaged by outwardly extending shoulder 129 on outer shell 101 during insertion. Thus, connector 26 is locked in position within tube 29 by retention ring 123 and shoulder 129 on connector 26, cooperating with shoulders 127 and 128 in tube 29, respectively.

Tube 29, having a connector 26 mounted therein, is then inserted in an aperture 24 in insert 21 in the direction indicated by arrow 126. During insertion, retention ring 131 will be compressed by the outer wall of tube 29. When, however, the retention ring 131 clears shoulder 115 on tube 29, ring 131 will spring outwardly to thereafter prevent withdrawal of the tube from the aperture in the direction opposite that of arrow 126. Insertion of tube 29 into aperture 24 is also limited by an internal shoulder 132 in aperture 23 being engaged by annular, outwardly extending shoulder 133 on tube 29. Thus, tube 29 is locked in position within aperture 24 by retention ring 131 and shoulder 132 in aperture 24, cooperating with shoulders 115 and 133 on tube 29, respectively.

The connector 26 can be removed from tube 29, and tube 29 can be removed from aperture 24 by compressing retention rings 123 or 131 inwardly with appropriate tools to permit the retention rings to clear shoulders 127 and 115, respectively, during withdrawal of the connector from the tube and the tube from the aperture in the direction opposite that of arrow 126.

Figure 5:
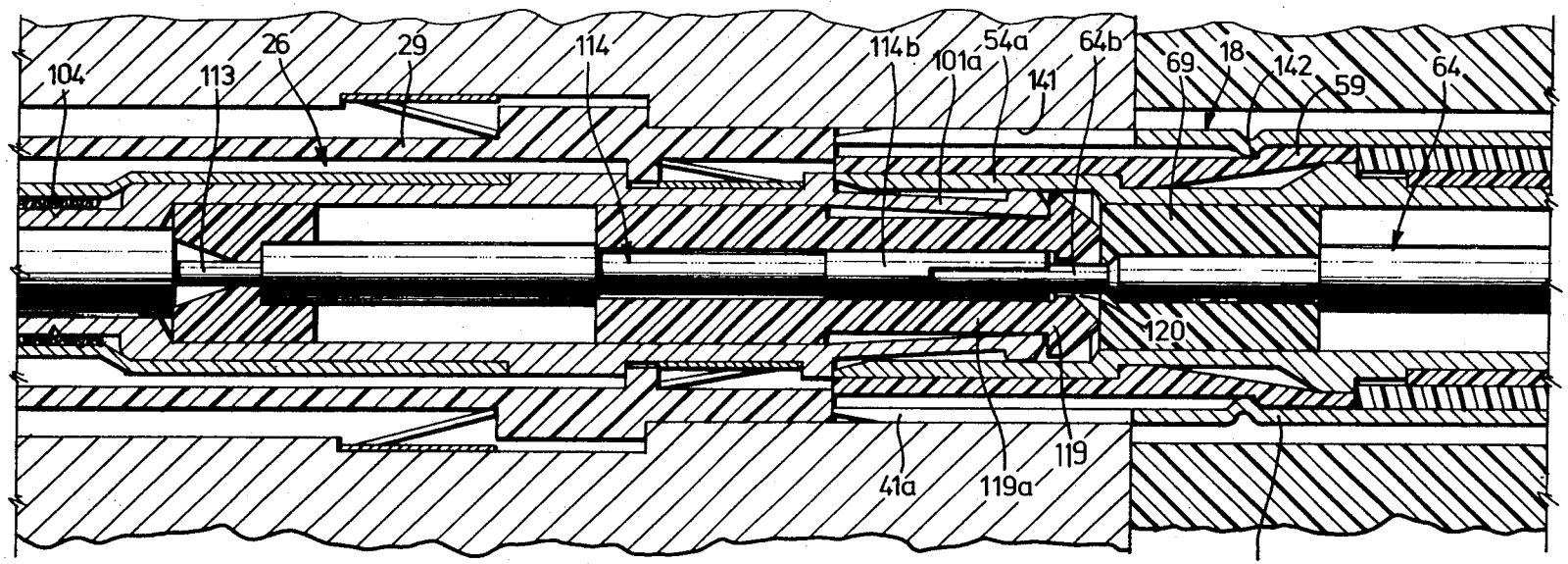
FIG. 5 is a cross-sectional view of a portion of the assembly of FIG. 1 in mated condition.

FIG. 5 illustrates portions of connector members 11 and 12 mated to one another to complete electrical circuits through the mated pin connector-socket connector pairs 18 and 26. As shown, upon mating of the connectors 18 and 26, the center pin contact portion 64*b* of triaxial connector 18 will pass through opening 120 in dielectric member 119 and enter center socket contact portion 114*b* of coaxial connector 26 to electrically connect the center conductor of the triaxial cable 19 and the center conductor of the coaxial cable 27. It will be noted also that the forward portion 119*a* of dielectric member 119 in coaxial connector 26 is somewhat pointed to engage dielectric member 69 in triaxial connector 18 to reliably seal between the two connectors when they are mated. Annular, inward rib 142 bears on the insulated portion 59 to retain the same in the assembly.

The outer contact fingers 101*a* of coaxial connector 26 are received within annular intermediate contact 54*a* of connector 18 and firmly press thereagainst to electrically connect the intermediate conductor of the triaxial cable 19 to the outer conductor of coaxial cable 26.

To terminate and ground the outer conductor 46 of triaxial cable 19, the spring contact fingers 41*a* of outer shell 41 of triaxial connector 18 are received within forward portion 141 of aperture 24 in insert 21 (see FIG. 1), and the spring fingers 41*a* will firmly press against the wall of aperture portion 141 to thereby electrically connect the outer conductor 46 of triaxial cable 19 to electrically conductive insert 21. The electrically conductive insert 21 is, of course, grounded, thereby grounding the outer conductor 46 of the triaxial cable. Reliable contact between contact fingers 41*a* and the wall of aperture portion 141 is assured by the radially outward bias of contact fingers 41*a*. As the contact fingers 41*a* are compressed inwardly by the forward portion 141 of aperture 24, fingers 41*a* are biased radially inward and remain engaged firmly against the surrounding wall portion 141 of aperture 24.

By connecting the outer contact fingers 41*a* of each triaxial connector in connector member 11 to electrically conductive insert 21 of connector member 12, any noise carried by the outer conductors 46 of triaxial cables 19 will be grounded through insert 21 and outer shell 22 to chassis ground. Because the outer conductor of the triaxial cable is also physically terminated at the connector assembly and is not continued through the assembly into the housing or enclosure for electronic circuitry, there is no risk of noise being inadvertently carried into the housing and to the circuitry.

While what has been described constitutes a presently most preferred embodiment, it should be understood that the invention can take numerous other forms. For example, as indicated above, the outer shells of the receptacle and plug connector members can be configured to support any number of inserts therein, and the inserts themselves may be configured in any desired manner. The various retaining means for retaining the connectors within the insert or the plastic tube, and for retaining the plastic tube within the insert can also take various other forms. Because the invention can take various embodiments, it should be understood that the invention is to be limited only insofar as is required by the scope of the following claims.

I claim:

1. An electrical connector assembly for connecting a plurality of triaxial cables to a plurality of coaxial cables, said assembly comprising:

a first connector member, said first connector member comprising a first connector insert supported within a first outer shell, said first connector insert having a plurality of apertures extending therethrough;

a triaxial connector supported within each of said plurality of apertures in said first connector insert, each of said triaxial connectors including a center contact, an intermediate contact and an outer contact adapted to be electrically connected to a center conductor, an intermediate conductor and an outer conductor of a triaxial cable; and a second connector member matable with said first connector member, said second connector member including a second electrically conductive connector insert supported within a second outer shell, said second connector insert having a plurality of apertures extending therethrough;

a plurality of coaxial connectors supported within said apertures in said second connector insert, each of said plurality of coaxial connectors including a center contact and an outer contact adapted to be electrically connected to the center conductor and the outer conductor of a coaxial cable, respectively; and an insulating tube for supporting each of said plurality of coaxial connectors within said apertures of said second connector insert for electrically insulating each of said coaxial connectors from said second connector insert, said contacts of said coaxial and triaxial connectors being positioned such that upon mating of said first and second connector members, the center contact of each triaxial connector will mate with the center contact of an aligned coaxial connector, the intermediate contact of each triaxial connector will mate with the outer contact of an aligned coaxial connector, and the outer contact of each triaxial connector will engage said second connector insert for providing a grounding path from the outer contacts of each triaxial connector through said second conductive insert and said second outer shell.

2. The connector assembly of claim 1 wherein said outer contacts of each of said triaxial connectors extend within said apertures in said second connector insert when said first and second connector members are mated, said outer contacts of said triaxial connectors engaging the walls of said apertures for providing said grounding path through said second connector insert.

3. An electrical connector assembly comprising:

a plurality of coaxial connectors connected to respective conductors of corresponding coaxial electrical cables, a plurality of triaxial connectors connected to respective conductors of corresponding triaxial electrical cables, and constructed for connection to corresponding said coaxial connectors, a conductive insert, a plurality of apertures extending through said conductive insert, insulative elongated individual tubes surrounding corresponding lengths of said coaxial connectors, said coaxial connectors being mounted within corresponding said apertures and individually insulated from said conductive insert by corresponding individual said insulative tubes and connected to corresponding said triaxial connectors inserted into said apertures, said triaxial connectors having outer shells constructed for engaging the conductive insert within said apertures and for coaxially surrounding corresponding said coaxial connectors, insulative means on said triaxial connectors for insulating said outer shells from corresponding said coaxial connectors, a second insert mounting said triaxial connectors, and first and second connector shells surrounding and engaging corresponding said inserts, the first said connector shell being conductive and completing a conductive path extending along said triaxial cables, along said outer shells of said triaxial connectors, through said conductive insert and through said first connector shell.

4. In an electrical connector assembly as recited in claim 3, the improvement further comprising: spaces within the apertures of the conductive insert and concentrically surrounding said coaxial connectors, said outer shells of said triaxial connectors within corresponding said spaces engaging the conductive insert and concentrically surrounding corresponding said coaxial connectors.

5. In an electrical connector assembly as recited in claim 3, the improvement further comprising: retaining means on corresponding said triaxial connectors for releasably retaining said triaxial connectors in said second insert.

6. In an electrical connector assembly as recited in claim 3, the improvement further comprising: spring retention means in said apertures of said conductive insert for releasably retaining corresponding said tubes.

7. In an electrical connector assembly as recited claim 3, the improvement further comprising: contact fingers of said outer shells of said triaxial connectors extending into said apertures for engaging said conductive insert, and said insulative means extending coaxially within the contact fingers of said outer shells for coaxially surrounding corresponding said coaxial connectors.

8. In an electrical connector assembly as recited in claim 3, the improvement further comprising: means on said coaxial connectors for releasably retaining said coaxial connectors in corresponding said tubes.

9. In an electrical connector assembly as recited in claim 4, the improvement further comprising: retaining means on corresponding said triaxial connectors for releasably retaining said triaxial connectors in said second insert.

10. In an electrical connector assembly as recited in claim 4, the improvement further comprising: spring retention means in said apertures of said conductive insert for releasably retaining corresponding said tubes.

11. In an electrical connector assembly as recited in claim 5, the improvement further comprising: spring retention means in said apertures of said conductive insert for releasably retaining corresponding said tubes.

12. In an electrical connector assembly as recited in claim 4, the improvement further comprising: contact fingers of said outer shells of said triaxial connectors extending into said apertures for engaging said conductive insert, and said insulative means extending coaxially within the contact fingers of said outer shells for coaxially surrounding corresponding said coaxial connectors.

13. In an electrical connector assembly as recited in claim 5, the improvement further comprising: contact fingers of said outer shells of said triaxial connectors extending into said apertures for engaging said conductive insert, and said insulative means extending coaxially within the contact fingers of said outer shells for coaxially surrounding corresponding said coaxial connectors.

14. In an electrical connector assembly as recited in claim 6, the improvement further comprising: contact fingers of said outer shells of said triaxial connectors extending into said apertures for engaging said conductive insert, and said insulative means extending coaxially within the contact fingers of said outer shells for coaxially surrounding corresponding said coaxial connectors.

15. In an electrical connector assembly as recited in claim 4, the improvement further comprising: means on said coaxial connectors for releasably retaining said coaxial connectors in corresponding said tubes.

16. In an electrical connector assembly as recited in claim 5, the improvement further comprising: means on said coaxial connectors for releasably retaining said coaxial connectors in corresponding said tubes.

17. In an electrical connector assembly as recited in claim 6, the improvement further comprising: means on said coaxial connectors for releasably retaining said coaxial connectors in corresponding said tubes.

18. In an electrical connector assembly as recited in claim 7, the improvement further comprising: means on said coaxial connectors for releasably retaining said coaxial connectors in corresponding said tubes.

* * * * *